US007014720B2

(12) United States Patent
Iseda

(10) Patent No.: US 7,014,720 B2
(45) Date of Patent: Mar. 21, 2006

(54) AUSTENITIC STAINLESS STEEL TUBE EXCELLENT IN STEAM OXIDATION RESISTANCE AND A MANUFACTURING METHOD THEREOF

(75) Inventor: Atsuro Iseda, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 194 days.

(21) Appl. No.: 10/378,905

(22) Filed: Mar. 5, 2003

(65) Prior Publication Data

US 2003/0231976 A1 Dec. 18, 2003

(30) Foreign Application Priority Data

Mar. 8, 2002 (JP) ..... 2002-064395

(51) Int. Cl.
*C22C 38/48* (2006.01)
*C22C 38/50* (2006.01)

(52) U.S. Cl. ..... 148/327; 420/53; 420/54

(58) Field of Classification Search ..... 148/909, 148/327, 592, 593, 607; 420/54; 165/905, 165/108
See application file for complete search history.

(56) References Cited

U.S. PATENT DOCUMENTS 4,382,829 A * 5/1983 Kanero et al. ..... 148/317
5,827,476 A * 10/1998 Linden et al. ..... 420/40
5,908,486 A 6/1999 Flinn et al.
6,146,582 A * 11/2000 Linden ..... 420/40

FOREIGN PATENT DOCUMENTS

| | | | |
|---|---|---|---|
| EP | 63033549 | 2/1988 | |
| EP | 06017119 | 1/1994 | |
| EP | 09165655 | 6/1997 | |
| EP | 09310157 | 12/1997 | |
| EP | 11256283 | 9/1999 | |
| JP | 57-029530 | 2/1982 | |
| JP | 58-087224 | 5/1983 | |
| JP | 358133352 | * 8/1983 | ..... 420/49 |
| JP | 58-167726 | 10/1983 | |
| JP | 61056234 | 8/1984 | |
| JP | 61-091326 | 5/1986 | |
| JP | 61-091327 | 5/1986 | |
| JP | 61-091328 | 5/1986 | |
| JP | S61-37335 | 8/1986 | |
| JP | 61-238913 | 10/1986 | |

* cited by examiner

*Primary Examiner*—Deborah Yee
(74) *Attorney, Agent, or Firm*—Clark & Brody

(57) ABSTRACT

The present invention provides an austenitic stainless steel tube with a uniform fine grained structure of regular grains, which is not changed to a coarse structure and the steam oxidation resistance is maintained even if the tube is subjected to a high temperature reheating during welding and high temperature bending working. The austenitic stainless steel tube consists of, by mass %, C: 0.03–0.12%, Si: 0.1–0.9%, Mn: 0.1–2%, Cr: 15–22%, Ni: 8–15%, Ti: 0.002–0.05%, Nb: 0.3–1.5%, sol. Al: 0.0005–0.03%, N: 0.005–0.2% and O (oxygen): 0.001–0.008%, and the balance Fe and impurities, the austenitic stainless steel tube having austenitic grain size number of 7 or more and a mixed grain ratio of preferably 10% or less.

8 Claims, 1 Drawing Sheet

(a)

(b)

AUSTENITIC STAINLESS STEEL TUBE EXCELLENT IN STEAM OXIDATION RESISTANCE AND A MANUFACTURING METHOD THEREOF

TECHNICAL FIELD

The present invention relates to an austenitic stainless steel tube, excellent in steam oxidation resistance and high temperature strength, which is used in a superheater, reheater, tubes and pipes for a boiler or chemical industry, and a manufacturing method thereof.

PRIOR ART

Ultra supercritical pressure boilers of high efficiency, with enhanced steam temperature and pressure, have recently been built in the world in order to save energy and to use resources efficiently, which reduces the $CO_2$ emission. A high efficient ultra supercritical pressure boiler is advantageous for an electric power-generation, which burns fossil fuel, and a reactor for chemical industry.

High temperature and high pressure steam increases the tube temperature during the actual operation of boiler and heating furnace. A steam oxidation scale exfoliates and damages the turbine blades or accumulates on the inner surface of the tube at a bent corner, then overheats the corner, which can lead to a possible breakage accident. Therefore, in addition to high temperature strength and corrosion resistance, excellent steam oxidation resistance on the inner surface of the tube is required for these steel tubes.

An austenitic stainless steel tube is much better in high temperature strength and corrosion resistance than a ferritic steel tube. Accordingly, austenitic stainless steel tubes can be used in high temperatures of 650° C. or more where the ferritic steel tubes cannot be used. However, even in the austenitic stainless steel tube, steam oxidation scales are produced on the inner surface of the tube and exfoliate. Various methods to prevent this phenomenon have been tried such as follows:

(1) A method of enhancing the corrosion resistance by increasing Cr content in the steel;

(2) A method of forming a chromized surface layer having high corrosion resistance;

(3) A method of subjecting a surface to shot peening or cold working to induce a strain on the surface, and then heat treating to make a fine grain surface layer (see for example Japanese Examined Patent Publication No. Sho-61-37335);

(4) A method of forming a carburized or nitrided surface layer and heat treating it to make a fine grain surface layer (see for example, Japanese Laid-Open Patent Publication No. Sho-57-29530); and (5) A method of making the entire steel a fine grained structure (see for example, Japanese Patent Laid-Open Patent Publications Nos. Sho-58-87224, 58-167726, 61-91326, 61-238913, 61-91327, and 61-91328).

However, the above-mentioned methods had the following disadvantages.

The method (1) means that a 18Cr-8Ni austenitic stainless steel, such as SUS 347H or SUS 304H used in a boiler, a heat exchanger tube for chemical industry and a heating furnace tube, must increase the Cr content and also the Ni content to ensure the stability of the structure. Such high Cr and Ni content materials as 22Cr-12Ni SUS 309, 25Cr-20Ni SUS 310 are expensive. They show high corrosion resistance but decrease effective weldability and workability. Further, new materials need an specification by the government, and it is also difficult to replace the tubes settled in the existing plant for new material tubes.

Steel tubes obtained by the method (2) are very expensive, and tube sizes are limited. The chromized layer can be broken when the tube is bent. Chromizing at high temperatures above 1100° C. takes a long time and may make a poor performance on the steel. Further, a portion having no chromized layer is produced during welding and can be significantly corroded.

In the methods (3) and (4), a formed fine grain in the surface layer easily becomes a coarse grain during high temperature bending, heating treatment and welding in the manufacturing processes, and fine grain could disappear. Once the fine grain layer changes to coarse grains, the reverse change never occurs.

In the method (5), a fine grained structure of the entire steel was developed such as an 18Cr-8Ni austenitic stainless steel, whose Nb and/or Ti content was balanced with the content of C and/or N, due to the forming precipitates of carbo-nitride of Nb and/or Ti during the cooling from molten steel, and the following 3-step treatments.

The first step is a preliminary solution treatment to resolve a carb-nitride of Nb or Ti. The second step is a cold working to accumulate strain, which accelerates the next step of the heat treatment. The third step is a final solution treatment at a lower temperature, by 30° C. or more, than the temperature of the preliminary solution treatment in order to develop the entire austenitic stainless steel into a fine grained structure.

However, the carbo-nitride of Nb or Ti formed in the method (5) has insufficient nucleation ability to precipitate dispersed fine grains after solution treatment at high temperatures. Further, the strain in the second step is difficult to uniformly accumulate. As a result, in the method (5), it is difficult to obtain a uniform fine grained structure with regulated grains and the final product is often liable to have a mixed grain structure with abnormally coarse grains. An abnormally thick lump-shaped steam oxidation scale can be formed at the coarse grain portion of the mixed grain structure, and is liable to exfoliate.

The carbo-nitride of Nb or Ti is lacking in stability at high temperatures and irresoluble again during welding and high temperature bending performed in manufacturing a boiler, resulting in the abnormal grain growth and the disappearance of the fine grained structure. Therefore, the method (5) cannot lead to the tube having a fine grained structure of uniform regular grains, which is not resoluble even in the manufacturing of a boiler.

A fine grained structure of the carbo-nitride of Nb or Ti improves steam oxidation resistance according to the following mechanism. To suppress steam oxidation due to high temperature steam, it is necessary to produce a stable and highly protective $Cr_2O_3$ film having high Cr concentration. However, this highly protective film is not produced if the Cr concentration in the surface layer of the steel is not sufficiently high. In an austenitic stainless steel the Cr diffusion of the steel is slow even at a temperature of 550 to 750° C., and in the case of 18Cr-8Ni stainless steel a highly protective film is not liable to be produced. On the contrary, the grain boundary diffusion occurs easily in the fine grained structure and Cr in the steel is sufficiently supplied to the surface. As a result, a highly protective film is produced on the surface of the steel thereby improving the steam oxidation resistance.

In the case of an 18Cr-18Ni austenitic stainless steel, there is such a strong relationship between the grain size and the steam oxidation resistance that finer grain steel exhibits a better steam oxidation resistance. A person skilled in the art knows well that if the fine grain is one having austenitic grain size defined in ASTM (American Society for Testing and Material) of No. 7 or more, the steam oxidation resistance is improved.

SUMMARY OF THE INVENTION

Accordingly, the first object of the present invention is to provide an inexpensive austenitic stainless steel tube having steam oxidation resistance, in which the entire structure is a uniform fine grained structure of regular grains and this fine grained structure does not change during welding and high temperature bending. Further, a second object of the present invention is to provide a method of manufacturing an austenitic stainless steel tube excellent in steam oxidation resistance, in which the fine grained structure does not change during welding and high temperature bending and, in which, creep strength can be also enhanced.

The following (1) to (4) are an austenitic stainless steel tube according to the present invention, and the following (5) and (6) are the manufacturing method thereof according to the present invention.

(1) An austenitic stainless steel tube excellent in steam oxidation resistance characterized by consisting of, by mass %, C: 0.03–0.12%, Si: 0.1–0.9%, Mn: 0.1–2%, Cr: 15–22%, Ni: 8–15%, Ti: 0.002–0.05%, Nb: 0.3–1.5%, sol.Al: 0.0005–0.03%, N: 0.005–0.2% and O (oxygen): 0.001–0.008%, and the balance Fe and impurities, and also characterized by having a fine grained structure wherein austenitic grain size is No.7 or more.

(2) An austenitic stainless steel tube excellent in steam oxidation resistance characterized by consisting of at least one alloying element selected from at least one group mentioned below in addition to the chemical composition of the (1) above, and the balance Fe and impurities, and also characterized by having a fine grained structure wherein austenitic grain size is No.7 or more.

The first group: Ca, Mg, Zr, B, Pd, Hf and REM of 0.0001–0.2 mass % respectively.

The second group: Cu, Mo and W of 0.01–5 mass % respectively.

(3) An austenitic stainless steel tube excellent in steam oxidation resistance, characterized by consisting of a chemical composition of either the (1) above or the (2) above, and also characterized by having a fine grained structure wherein an austenitic grain size is No.7 or more and a mixed grain ratio is 10% or less.

(4) An austenitic stainless steel tube excellent in steam oxidation resistance according to any one of the (1) to (3) above, characterized by the O (oxygen) content of not less than 0.001 mass % but less than 0.005 mass %.

(5) A method of manufacturing an austenitic stainless steel tube excellent in steam oxidation resistance, characterized by comprising the following steps (a) to (c):

(a) Heating a austenitic stainless steel tube at a temperature from 1100 to 1350° C. and cooling at a cooling rate not smaller than 0.25° C./sec, wherein the tube consists of the chemical composition mentioned in any one of the (1) to (4) above.

(b) Working the tube at a cross-sectional reduction ratio not less than 10% at a temperature not higher than 500° C.

(c) Heating the hot worked tube at a temperature from 1050 to 1300° C. and lower, by 10° C. or more, than the temperature of (a) above, and cooling.

(6) A method of manufacturing an austenitic stainless steel tube excellent in steam oxidation resistance characterized by comprising the following steps (d) to (h):

(d) Heating an austenitic stainless steel at a temperature from 1100 to 1350° C., wherein the steel consists of the chemical composition mentioned in any one of the (1) to (4) above.

(e) Making a tube by hot-working of the said steel.

(f) Cooling the tube at a cooling rate less than 0.25° C./sec.

(g) Working the tube at a cross-sectional reduction ratio of not less than 10% at a temperature not higher than 500° C.

(h) Heating the hot worked tube at a temperature from 1050 to 1300° C. and lower, by 10° C. or more, than the temperature of the (d) above, and cooling.

The austenitic grain size means a grain size defined in the above-mentioned ASTM.

Further, the mixed grain ratio (%) of the austenitic crystal grains is defined by an expression of $\{(n/N)\times 100\}$, wherein N is the number of fields observed in judgment of the above-mentioned austenitic grain size, and n is the number of fields judged as mixed grains when grains exist whose size is different, by about 3 or more, from that of grains having the maximum frequency within one field, and in which these grains occupy about 20% or more of area.

DESCRIPTION OF THE PREFERRED EMBODIMENT

Figure 1:
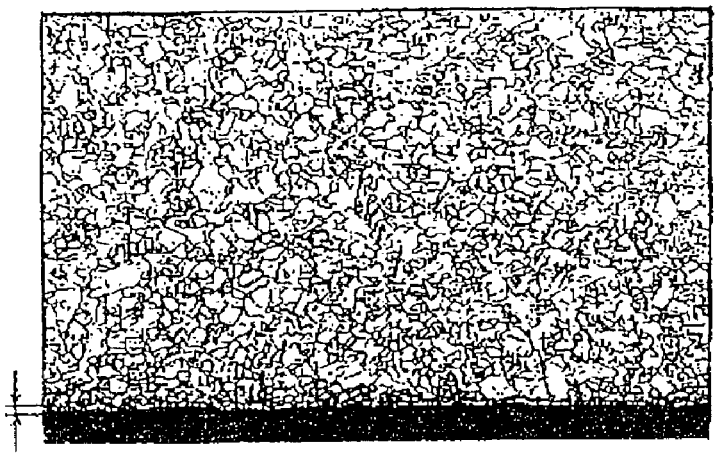
FIG. 1 shows one example of a state of producing steam oxidation scales, which are produced on an inner surface of a steel tube. Particularly, FIG. 1(*a*) is a case of a steel tube according to the present invention, and FIG. 1(*b*) is a case of a steel tube of a comparative example.
Figure 1:
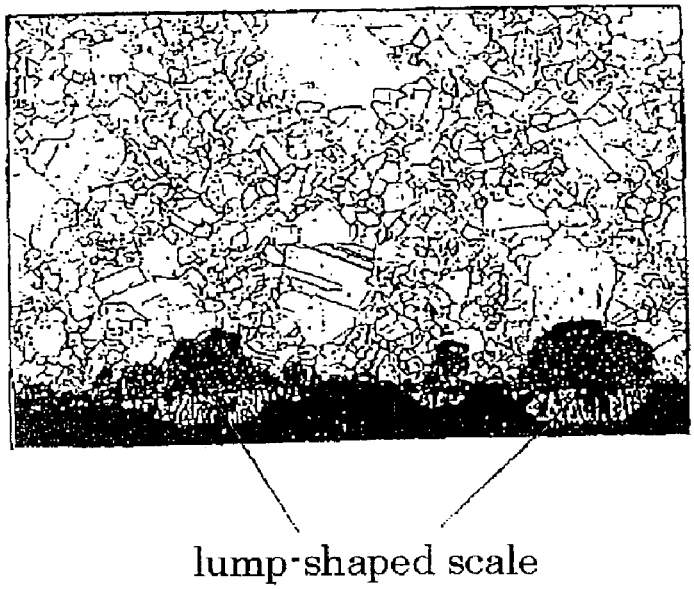

The present inventors have variously studied the finely granulating technology of an 18Cr-8Ni austenitic stainless steel. As a result, the present inventors have obtained the following new knowledge:

The prior art of making the entire steel fine grained structure utilizes carbo-nitride of Nb or Ti. However, in this prior art, the carbo-nitride of Nb or Ti is lacking in stability at high temperature and it is difficult to easily obtain a uniform fine grained structure of regular grains. Further, the carbo-nitride of Nb or Ti is too resoluble or coagulative to maintain the fine grained structure.

Therefore, the present inventors made an effort to find a stable formation of the uniform fine grained structure of regular grains, which is not resoluble even if reheating is performed. As a result, the following facts have been found.

(a) In a Nb contained steel dispersed with uniform $Ti_2O_3$, a uniform composite in which the Nb carbo-nitride was dispersedly precipitated around a nucleus of $Ti_2O_3$ during the heat treatment of the steel tube.

(b) The above-mentioned composite has the same finely granulating action as that of carbo-nitride of Nb or Ti. Therefore, using this property of the composite, a uniform fine grained structure of regular grains can easily be obtained. Additionally, since the composite is not resoluble even at high temperatures, the fine grained structure can be maintained during welding or high temperature bending.

(c) The steel dispersed with uniform $Ti_2O_3$ before the solution treatment mentioned in (a) above can be produced by eliminating inclusions such as $Al_2O_3$, $SiO_2$ from the molten steel, adding a suitable amount (0.3–1.5 by mass %)of Nb to the molten steel, adjusting the oxygen content of steel to a proper range (0.001–0.008 by mass %), and then adding a suitable amount (0.002–0.05 by mass %) of Ti.

(d) The steel dispersed with a uniformly dispersed composite is produced after the solution treatment as mentioned in (a) above, which is called the preliminary solution treatment.

(e) The steam oxidation resistance in the austenitic stainless steel that does not generate lump-shaped steam oxidation scales can be ensured by a final solution treatment if the austenitic stainless steel has a micro structure, whose austenitic grain size, described in ASTM, is 7 or more, and the steam oxidation resistance is further improved in a case where the degree of mixed grains in the micro structure is 10% or less by the above-described mixed grain ratio.

(f) The micro structure described in the (e) above can be obtained during the final solution treatment at a lower temperature, by 10° C. or more, than the preliminary solution treatment temperature mentioned in (d) above, and a high creep strength product can be obtained. On the contrary, according to the prior art using the carbo-nitride of Nb or Ti, the final solution treatment temperature has to be set at a lower temperature, by 30° C. or more, than the preliminary solution treatment temperature, and a lower creep strength product can be obtained.

Reasons why various conditions such as chemical composition, grain size and mixed grain ratio as well as manufacturing methods, according to austenitic stainless steel tube of the present invention, which have been described above will be explained below. The "%" means "% by mass" in the following descriptions as long as the "%" is not further explained.

C: 0.03–0.12%

C (carbon) is an alloying element necessary for ensuring high temperature tensile strength and high temperature creep strength, which are necessary in high temperature austenitic stainless steel, and a content of at least 0.03% or more carbon is needed. However, if the content of carbon exceeds 0.12%, Cr nitride is increased and weldability is decreased. Thus, the upper limit was set to 0.12%. A preferable content of C is 0.05–0.1%.

Si: 0.1–0.9%

Although Si (Silicon) is added as deoxidant during steel making, it is also an effective element to enhance steam oxidation resistance of steel. Appropriate deoxidation must be performed during steel making to precipitate a uniformly fine $Ti_2O_3$. Accordingly, Si content of at least 0.1% or more is needed. However, if the content becomes excessive, the workability of the steel becomes worse, so the upper limit of Si content was set to 0.9%. The preferable range of the Si content is 0.1–0.75%.

Mn: 0.1–2%

Mn (Manganese) fixes with an impurity of S contained in steel to form MnS, whereby hot workability is enhanced. However, if the Mn content is less than 0.1% this effect cannot be obtained. On the other hand, if the Mn content becomes excessive, the steel becomes hard and brittle and the workability and weldability of the steel decreases. Accordingly, the upper limit of Mn content was set to 2% and a preferable Mn content is 0.2–1.7%.

Cr: 15–22%

Cr (Chromium) is an important alloying element to ensure oxidation resistance, steam oxidation resistance and corrosion resistance. The Cr content required for an austenitic stainless steel is at least 15%. The more Cr content is, the more respective corrosion resistance improves. However, the stability of the structure of the austenitic stainless steel is decreased. Accordingly, to stabilize the austenitic structure, an increase in an expensive Ni content is required which decreases weldability of the austenitic stainless steel. Therefore, Cr content is set to 15–22% and a preferable range of the Cr content is 17–20%.

Ni: 8–15%

Ni (Nickel) is an alloying element, which stabilizes the austenitic structure in the austenitic stainless steel, and is important to ensure corrosion resistance. The lower limit of Ni content is 8% from a balance with the above-described Cr content. On the other hand, excessive Ni content not only leads to an increase in cost, but also leads to reduction in creep strength. Accordingly, the upper limit is set to 15% and a preferable range of the upper limit is 8.5–13%.

Ti: 0.002–0.05%

Ti (Titanium) is an indispensable alloying element in order to produce a uniformly dispersed $Ti_2O_3$, which becomes a nucleus of the said composite that is one of characteristics of a steel tube according to the present invention similar to O (Oxygen), which will be described later. When the Ti content is less than 0.002%, $Ti_2O_3$ is not produced, and even if $Ti_2O_3$ is produced, the amount of the uniformly dispersed $Ti_2O_3$ is too little to have any effect. On the other hand, when the Ti content exceeds 0.05%, coarse TiN is produced and the TiN prevents the Nb carbo-nitride from finely dispersed precipitation around the nucleus of the $Ti_2O_3$, so that the production of a finely dispersed composite, having $Ti_2O_3$ as a nucleus, is not possible. Therefore, Ti content should range 0.002–0.05% and a preferable range of Ti is 0.002–0.03%.

Nb: 0.3–1.5%

Nb (Niobium) is an indispensable alloying element to produce the composite, and a Nb content of at least 0.3% is needed. If Nb is contained by 1.5% or more, a remarkably coarse composite is precipitated and its strength is lowered, therefore, the Nb content was set to 0.3–1.5% and a preferable range of the Nb content is 0.4–1.3%.

sol. Al: 0.0005–0.03%

Al (Aluminum) is added as deoxidant. However, if a large amount of Al is added, the additional effect of Ti is lost, so Al content is set up to 0.03% by sol. Al content. On the other hand, to obtain a sufficient deoxidation effect 0.0005% or more sol. Al content is needed. A preferable sol. Al content is 0.001–0.02%.

N: 0.005–0.2%

N (Nitrogen) is an alloying element that has solid solution and precipitation strengthening due to Nb carbo-nitride. If the N content is 0.005% or less, the effects cannot be obtained, but,on the other hand, if the N content exceeds 0.2%, a lump-shaped nitride is produced. This nitride not only deteriorates the steel quality, but also inhibits the finely dispersed precipitation of the said composite. Therefore, N content was set to 0.005–0.2% and a preferable range of the N content is 0.01–0.15%.

O (Oxygen): 0.001–0.008%

O is an indispensable element to produce uniformly dispersed $Ti_2O_3$, which becomes a nucleus of the said composite precipitation similar to the above-mentioned Ti. If the O content is less than 0.001%, $Ti_2O_3$ is not produced but,on the other hand, if the O content exceeds 0.008%, coarse oxide other than $Ti_2O_3$ is produced, which remarkably deteriorates the steel quality, by decreasing its strength and toughness. Therefore, the O content was set to 0.001–0.008% and a preferable range of the O content is 0.001% or more, and is less than 0.005%.

The finely dispersed precipitation of $Ti_2O_3$ becomes possible by eliminating inclusions such as $Al_2O_3$, $SiO_2$ from molten steel, adding a suitable amount (0.3–1.5 by mass %)of Nb to the molten steel, adjusting the oxygen content of steel to a proper range (0.001–0.008 by mass %), and then adding a suitable amount (0.002–0.05 by mass %) of Ti. Examples of suitable eliminating methods used in this case can include a vacuum oxygen decarburization (VOD), an argon oxygen decarburization atmosphere melting method (AOD) and the like. The molten steel before adding Ti is preferred to have high purity One of austenitic stainless steel tubes excellent in steam oxidation resistance according to the present invention, consists of the above-mentioned chemical composition as well as the balance Fe and impurities, and the austenitic grain size and mixed grain ratio which are adjusted as mentioned above.

Another austenitic stainless steel tube excellent in steam oxidation resistance according to the present invention, further contains at least one alloying element selected from at least one group mentioned below.

First Group (Ca, Mg, Zr, B, Pd, Hf and REM)

All of these alloying elements are effective in enhancing strength, workability and steam oxidation resistance. Therefore, in a case where these effects are required, one or more alloying element may be positively contained. The addition of 0.0001% or more of an alloying element remarkably increases the effects respectively, however, if the respective alloying element contents exceed 0.2%, workability and weldability are impaired. Thus, the alloying element contents in a case of the addition of an alloying element may be set to 0.0001–0.2%, respectively, and preferably 0.0001–0.1% respectively. It is noted that the above-mentioned REM means La, Ce, Y, and Nd.

Second Group (Cu, Mo and W)

These elements all act on improving strength. Therefore, in a case where these effects are required, one or more alloying element may be positively contained. In this case, the addition of 0.1% or more of an alloying element remarkably increases the effects respectively, however, if the respective alloying element contents exceed 5%, toughness, ductility, and workability are impaired. Thus, the alloying element contents in a case of the addition of an element may be set to 0.1–5%, respectively, and a more preferable range is 0.05–4.5%.

Smaller contents of P and S in impurities are preferred and the upper limits of their contents are not particularly defined. However, an excessive reduction of their contents leads to an increase in cost. Therefore, the allowable upper limits of P content and S content may be 0.040% and 0.030%, respectively like SUS 304 or the like.

Impurities other than P and S include Co, which can be mixed from scrap, however, Co does not affect the properties of the steel tubes of the present invention. Therefore, the Co content in the mixing case as an impurity is not particularly limited. However, since Co is also a radioactive element, the Co content in the mixing case may be 0.8% or less, preferably 0.5% or less.

Next, the methods of manufacturing an austenitic stainless steel tube, according to the present invention, will be described. The first method (a method according to claims 6 and 7) is a method in which a steel tube of a predetermined size is subjected to working heat treatment and the steel tube of a determined size is obtained. A second method (a method according to claims 8 and 9) is a method in which a steel billet or slab (e.g. round shaped steel) is subjected to tube forming, cold working and solution treatment and the steel tube of a determined size is obtained. The material is produced by a usual melting and casting method.

Here, the step(d) and the step (f) in the second method correspond to the step (a) in the first method, and are referred to as the preliminary solution treatment. Further, the step (g) in the second method is the same as the step (b) in the first method, and the steps (b) and (g)are referred to as the cold working. Further, the step(h) in the second method and the step (c) in the first method are the same, and are referred to as the final solution treatment hereinbelow.

Preliminary Solution Treatment:

In the method of the present invention, before the plastic working that is performed before the final solution treatment, a tube is heated so that Nb carbo-nitride is sufficiently resolved. Thus, the tube must be heated to 1100° C. or more, however, if the steel is heated to a temperature above 1350° C., high temperature intergranular cracking or a decrease of ductility occurs.

It is noted that in the second method of the present invention, a steel billet is formed into a tube by hot extruding which is represented as the Ugine-Sejournet process, or by rolling which is represented as Mannesman plug mill process and Mannesman mandrel mill process.

Then, the heated steel tube in the first method, and the formed steel tube in the second method are cooled. When the cooling rate is less than 0.25° C./sec, a coarse Nb carbonitride or Cr carbide is precipitated during cooling the steel. When the cooling rate is not less than 0.25° C./sec, a finely dispersed composite of Nb is produced. Therefore, the cooling rate is required to be not less than 0.25° C./sec to obtain a fine grained structure. The cooling rate of not less than 0.25° C./sec is preferably required during cooling the steel from 800° C. to 500° C.

Therefore, the heating temperature of the preliminary solution treatment was set to 1100–1350° C. and the cooling rate was set to 0.25° C./sec or more. Preferable heating temperature is 1150–1270° C., and preferable cooling rate is 1° C./sec or more. Higher cooling rate is preferred but the upper limit is not determined.

Cold Working:

Cold working is necessarily to accumulate strain to accelerate the final solution treatment. However, if the working temperature exceeds 500° C., strain is not sufficiently accumulated. Besides, if the cross-sectional reduction ratio is less than 10%, a required fine grained structure cannot be obtained after the final solution treatment is performed because strain necessary for recrystallization cannot be imparted to the steel. Thus, cold working was performed at a temperature of 500° C. or less and at a cross-sectional reduction ratio of 10% or more. The upper limit of a desired working temperature is 300° C. and the lower limit of a desired cross-sectional reduction ratio is 20%. Further, since a higher cross-sectional reduction ratio is preferred, the upper limit of the cross-sectional reduction ratio is not defined. However, the maximum value of usual working of the cross-sectional reduction ratio is about 90%. Further, this working step determines the size of a product steel tube.

Final Solution Treatment:

This final solution treatment is necessary for obtaining a required fine grained structure. If a heating temperature for this solution treatment is lower than 1050° C., sufficient recrystallization does not occur. Thus, fine grained structure cannot be obtained, and grains become a flatly worked structure, which impairs creep strength. On the contrary, if the heating temperature for this solution treatment exceeds 1300° C., high temperature intergranular crack or a decrease in ductility occurs. Further, if the heating temperature of the final solution treatment is set to a lower temperature, by 10° C. or more, than the temperature of the preliminary solution treatment, the effects of the present invention cannot be obtained, and as a result the structure of the steel becomes coarse grains. Therefore, the final solution treatment was performed at a temperature of 1050–1300° C. and a lower temperature, by 10° C. or more, than the temperature of the preliminary solution treatment. A preferable heating temperature is 1140–1240° C. and a lower temperature, by 10° C. or more, than the temperature of the preliminary solution treatment. It is noted that although the cooling rate after heating steel is not limited, it is preferably set to 0.25° C./sec or more. Because, if the steel tube is cooled at a cooling rate lower than 0.25° C./sec, coarse precipitates (Nb carbonitride and Cr carbide) are produced and strength and corrosion resistance of the steel tube are impaired.

EXAMPLES

Example 1

Twenty kinds of steels, having chemical compositions shown in Table 1, were melted. The steels of Nos. 1 to 13 and Nos. 17 to 20 were melted by use of a vacuum melting furnace of a volume of 50 kg, and the obtained ingots were finished to steel plates by the following Manufacturing Method A. The working conditions correspond to the manufacturing conditions of a steel tube by the first method. Further, the steels of Nos. 14 to 16 were melted by use of a vacuum melting furnace of a volume of 150 kg, and forged billets from ingots were finished to steel tubes by the following Manufacturing Method B.

(1) Manufacturing Method A (Corresponding to Second Method)

Step 1: Heating at 1220° C.;

Step 2: Forming to a steel plate having a thickness of 15 mm by hot forging;

Step 3: Cooling at a rate of 0.55° C./sec from 800° C. to 500° C. or less;

Step 4: Forming to a steel plate having a thickness of 12 mm by grinding the outer surface of the material;

Step 5: Rolling of a cross-sectional reduction ratio of 30% at room temperature; and Step 6: Water cooling after holding the ingot at 1200° C.

(2) Manufacturing Method B (Corresponding to First Method)

Step 1: Forming a billet from an ingot having an outer diameter of 175 mm by hot forging and grinding the outside;

Step 2: Heating the billet at 1250° C.;

Step 3: Extruding the billet and forming it into a steel tube having an outer diameter of 64 mm and a wall thickness of 10 mm;

Step 4: Heating the steel tube at 1200° C. for ten minutes and cooling at a rate of 1° C./sec;

Step 5: Drawing the steel tube at a cross-sectional reduction ratio of 33% at room temperature; and Step 6: After maintaining the drawn steel tube at 1200° C. for ten minutes, water cooling the tube.

TABLE 1

| Steel | | Chemical Composition (unit: mass %, balance: Fe and impurities) | | | | | | | | | | | | |
|---|---|---|---|---|---|---|---|---|---|---|---|---|---|---|
| | No. | C | Si | Mn | P | S | Cr | Ni | Ti | Nb | sol.Al | N | O | others |
| Present | 1 | 0.09 | 0.11 | 1.45 | 0.006 | 0.002 | 18.42 | 11.45 | 0.007 | 0.76 | 0.005 | 0.043 | 0.0065 | Ca:0.0005 |
| invention | 2 | 0.05 | 0.25 | 1.89 | 0.024 | 0.001 | 18.78 | 12.75 | 0.005 | 0.80 | 0.001 | 0.065 | 0.0036 | — |
| | 3 | 0.06 | 0.90 | 1.98 | 0.003 | 0.001 | 18.98 | 12.37 | 0.015 | 0.52 | 0.016 | 0.108 | 0.0021 | Mg:0.0010 |
| | 4 | 0.08 | 0.45 | 0.11 | 0.029 | 0.002 | 21.98 | 14.89 | 0.006 | 1.06 | 0.019 | 0.197 | 0.0079 | Mo:2.30 |
| | 5 | 0.12 | 0.33 | 0.15 | 0.031 | 0.003 | 15.02 | 8.23 | 0.002 | 1.47 | 0.001 | 0.006 | 0.0076 | B:0.0017, Mg:0.0034, Nd:0.05 |
| | 6 | 0.07 | 0.34 | 0.65 | 0.015 | 0.003 | 16.75 | 9.90 | 0.038 | 0.59 | 0.029 | 0.017 | 0.0042 | Zr:0.0007 |
| | 7 | 0.03 | 0.45 | 0.98 | 0.026 | 0.002 | 20.12 | 11.21 | 0.049 | 0.31 | 0.011 | 0.140 | 0.0017 | — |
| | 8 | 0.06 | 0.67 | 0.35 | 0.028 | 0.002 | 18.48 | 10.03 | 0.013 | 0.72 | 0.007 | 0.076 | 0.0021 | La:0.14 |
| | 9 | 0.08 | 0.32 | 1.45 | 0.019 | 0.001 | 17.63 | 10.45 | 0.034 | 0.88 | 0.003 | 0.034 | 0.0032 | Ce:0.18 |
| | 10 | 0.09 | 0.44 | 1.60 | 0.008 | 0.002 | 18.30 | 12.78 | 0.011 | 0.92 | 0.018 | 0.050 | 0.0076 | — |
| | 11 | 0.11 | 0.18 | 1.56 | 0.028 | 0.003 | 20.75 | 14.33 | 0.020 | 0.99 | 0.009 | 0.128 | 0.0037 | Pd:0.12 |
| | 12 | 0.06 | 0.38 | 1.78 | 0.031 | 0.001 | 19.65 | 12.65 | 0.004 | 1.34 | 0.003 | 0.078 | 0.0011 | W:0.56, Mg:0.0020, Ca:0.0003 |
| | 13 | 0.11 | 0.36 | 1.55 | 0.013 | 0.002 | 18.73 | 12.34 | 0.009 | 1.21 | 0.017 | 0.072 | 0.0068 | Y:0.08 |
| | 14 | 0.10 | 0.41 | 1.87 | 0.012 | 0.002 | 18.45 | 10.89 | 0.012 | 1.07 | 0.014 | 0.036 | 0.0050 | — |
| | 15 | 0.06 | 0.31 | 1.43 | 0.026 | 0.002 | 19.03 | 13.23 | 0.009 | 0.49 | 0.009 | 0.062 | 0.0025 | Mo:0.56, W:1.06, B:0.0034 |
| | 16 | 0.07 | 0.45 | 1.72 | 0.023 | 0.003 | 18.72 | 10.97 | 0.013 | 0.60 | 0.023 | 0.075 | 0.0031 | Cu:2.45 |
| Compar- | 17 | 0.08 | 0.21 | 1.23 | 0.028 | 0.003 | 19.74 | 8.92 | *— | 0.62 | 0.020 | 0.065 | 0.0067 | — |
| ative | 18 | 0.12 | 0.42 | 1.63 | 0.020 | 0.002 | 16.51 | 9.28 | 0.049 | 0.39 | 0.029 | 0.128 | *— | — |
| | 19 | 0.08 | 0.38 | 1.11 | 0.021 | 0.003 | 18.72 | 11.98 | *0.25 | 0.62 | 0.009 | 0.103 | *0.0103 | — |
| | 20 | 0.08 | 0.38 | 1.11 | 0.021 | 0.003 | 18.72 | 11.98 | 0.018 | *0.24 | 0.009 | 0.103 | 0.0045 | — |

Note:

*shows out of scope of the present invention.

The austenitic grain sizes and the mixed grain ratios of the finished steel plates and tubes were examined respectively and the finished steel plates and tubes were subjected to a reheat treatment; holding them at 1200° C. for thirty minutes and water cooling, as well as in heat treatment in manufacturing processes. Then the austenitic grain sizes and mixed grain ratios were examined again and the examined steel plates and tubes were subjected to the steam oxidation test under the following conditions, to examine their steam oxidation resistance. It should be noted that the austenitic grain size was measured in accordance with the method defined in ASTM and the mixed grain ratio was also obtained by the same method. In that case, twenty fields were observed.

Steam Oxidation Test Conditions and the Evaluation Method;

Test conditions;

Steam temperature: 700° C.

Exposure time: 1000 hr.

Evaluation method;

The sections of test sample were observed with a microscope of a magnification of 100 times, and the thicknesses of only the densed scales on the inner layer were measured for arbitrary ten fields. On the contrary, scales which were porous or liable to exfoliate were neglected. Their average value was defined as a thickness of steam oxidation scale on the test sample.

The above results are shown in Table 2 together with austenitic grain size and mixed grain ratios before and after re-solution treatment.

TABLE 2

| | | | Grain size and mixed am ratio(%) | | | | | | |
|---|---|---|---|---|---|---|---|---|---|
| | | | After final solution treatment | | After re-solution treatment | | | | High |
| | | | | Mixed | | Mixed | Steam oxidation scale | | temperature |
| Steel No. | | Method | Grain size | grain ratio | Grain size | grain ratio | Average thickness | uniformity | strength (Mpa) |
| present | 1 | A | 9.2 | 5 | 8.7 | 10 | 21 | very good | 113 |
| invention | 2 | A | 9.8 | 0 | 8.5 | 5 | 12 | very good | 92 |
| | 3 | A | 8.5 | 0 | 8.0 | 0 | 17 | very good | 110 |
| | 4 | A | 7.6 | 5 | 7.8 | 5 | 12 | very good | 138 |
| | 5 | A | 9.2 | 5 | 8.5 | 5 | 20 | very good | 130 |
| | 6 | A | 11.0 | 15 | 10.3 | 15 | 20 | good | 118 |
| | 7 | A | 8.4 | 5 | 8.0 | 10 | 16 | very good | 95 |
| | 8 | A | 9.3 | 0 | 8.8 | 5 | 14 | very good | 115 |
| | 9 | A | 9.5 | 5 | 8.1 | 10 | 13 | very good | 120 |
| | 10 | A | 7.8 | 5 | 7.5 | 5 | 21 | very good | 100 |
| | 11 | A | 10.5 | 0 | 9.3 | 10 | 7 | very good | 112 |
| | 12 | A | 9.6 | 0 | 8.7 | 5 | 18 | very good | 121 |
| | 13 | A | 8.5 | 0 | 7.5 | 5 | 22 | very good | 123 |
| | 14 | B | 9.3 | 5 | 8.0 | 10 | 19 | very good | 108 |
| | 15 | B | 8.9 | 5 | 8.1 | 5 | 15 | very good | 140 |
| | 16 | B | 10.3 | 15 | 10.0 | 20 | 28 | good | 138 |
| compar- | 17 | A | 8.5 | 15 | 6.0 | 30 | 52~80 | bad | 50 |
| ative | 18 | A | 9.2 | 20 | 6.5 | 30 | 43~90 | bad | 53 |
| | 19 | A | 7.4 | 20 | 6.3 | 30 | 55~70 | bad | 55 |
| | 20 | A | *5.4 | 10 | 4.8 | 10 | 78 | very good | 60 |

Note1:
*shows out of scope of the present invention.
Note2:
High temperature strength means creep rupture strength at a test temperature of 700° C. and time of 10 thousand hours.

As can be seen from Table 2, the test sample of Nos. 1 to 16, which satisfy the chemical composition and manufacturing conditions defined in the present invention, have the maximum scale thickness in the inner layer of 28 μm, which is thin and excellent in steam oxidation resistance. Further, in a case where the test materials have substantially the same grain size, the material having smaller mixed grain ratio has a thin scale thickness in the inner layer and an excellent steam oxidation resistance. Further, thickness uniformity of the scale is good or very good as shown in FIG. 1(*a*).

On the contrary, the test samples of Nos. 17 to 20, which satisfy the manufacturing conditions defined in the present invention, but which do not satisfy the chemical compositions of steel defined in the present invention, have the minimum scale thickness in the inner layer of 43 μm, which is thick and poor in steam oxidation resistance. Further, the scales of test materials of Nos. 17 to 19 steels, having large mixed grain ratios, are lump-shaped and the thickness uniformity of the scale is not good as shown in FIG. 1(*b*).

Example 2

A steel plate of steel No. 2 shown in Table 1 is formed having a thickness of 15 mm by hot forging, and was subjected to the preliminary solution treatment, the cold working, and the final solution treatment in the various conditions shown in Table 3.

With the obtained steel plate, the austenitic grain size and mixed grain ratios were examined as in Example 1, and re-solution treatment, whose conditions are the same in Example 1, was performed. The austenitic grain size and mixed grain ratio were examined, and then, the steel plate was subjected to steam oxidation test, with the same testing conditions as in Example 1, and the steam oxidation resistance was examined. The result was also shown in Table 3.

Further, their austenitic grain size, mixed grain ratios and steam oxidation scale thicknesses were examined by the same methods as in Example 1. Further, the first sample of the steel No. 2 in Table 3 is the same as the steel No. 2 in Table 2.

TABLE 3

| Steel No. 2 | | | | | | | | | | | | |
|---|---|---|---|---|---|---|---|---|---|---|---|---|
| Preliminary solution treatment | | Working | | Final solution treatment | | Grain size and mixed grain ratio(%) | | | | | | High temperature |
| | | | Cross- | | | After final solution treatment | | After resolution | | Steam oxidation scale | | |
| Heating temperature(° C.) | Cooling rate (° C./sec) | Working temperature(° C.) | sectional reduction-ratio(%) | Heating temperature(° C.) | Cooling rate (° C./sec) | Grain size | Mixed grain ratio | Grain size | Mixed grain ratio | Average thickness | Uniformity | strength (Mpa) |
| 1220 | 0.55 | Room temperature | 30 | 1200 | 0.55 | 9.8 | 0 | 8.5 | 5 | 12 | Very good | 92 |
| *1080 | 0.55 | Room temperature | 30 | 1200 | 0.55 | *4.0 | 25 | 3.5 | 30 | 52~107 | Bad | 110 |
| 1220 | *0.18 | Room temperature | 30 | 1200 | 0.55 | 8.1 | 30 | 6.5 | 30 | 40~70 | Bad | 103 |
| 1220 | 0.55 | *600 | 30 | 1200 | 0.55 | *4.5 | 20 | 3.8 | 25 | 48~105 | Bad | 108 |
| 1220 | 0.55 | Room temperature | *5 | 1200 | 0.55 | *3.8 | 20 | 3.0 | 30 | 60~120 | Bad | 110 |
| 1220 | 0.55 | Room temperature | 30 | *1220 | 0.55 | *6.8 | 10 | 6.0 | 10 | 45~85 | Bad | 107 |

Note1:
*shows out of scope of the present invention.
Note2:
High temperature strength means creep rupture strength at a test temperature of 700° C. and time of 10 thousand hours.

As can be seen from Table 3, the steel plate subjected to preliminary solution treatment, plastic working and final solution treatment, which are out of scope of the present invention, each have remarkably coarse austenitic grains after reheating treatment, and have at least 40 $\mu$m in scale thickness on the inner surface, which is thick. Further, their steam oxidation resistance is poor and the scales on the inner layer are lump-shaped.

INDUSTRIAL APPLICABILITY

Even if the austenitic stainless steel tube, according to the present invention, is reheated at high temperature, the fine grained structure is maintained and steam oxidation resistance is not impaired. Accordingly, in an ultra supercritical pressure boiler, using this steel tube as an heat exchanger tube operating at 600° C. or more, its security and service life are dramatically improved. Further, the high temperature bending working during boiler manufacturing or the post heat treatment after welding can be performed without any problems. Additionally, according to the present invention, the final solution treatment can be performed at higher temperatures as compared with the prior art. A steel tube, excellent in steam oxidation resistance, which has higher creep strength as compared with conventional steel tubes, can be manufactured.

The invention claimed is:

1. An austenitic stainless steel tube excellent in steam oxidation resistance, characterized by consisting of, by mass %, C: 0.03–0.12%, Si: 0.1–0.9%, Mn: 0.1–2%, Cr: 15–22%, Ni: 8–15%, Ti: 0.002–0.05%, Nb: 0.3–1.5%, sol.Al: 0.0005–0.03%, N: 0.005–0.2% and O (oxygen): 0.001–0.008%, and the balance Fe and impurities, and also characterized by an entire structure having a uniform fine-grained structure wherein austenitic grain size is ASTM No. 7 or more.

2. An austenitic stainless steel tube excellent in steam oxidation resistance, characterized by consisting of, by mass %, C: 0.03–0.12%, Si: 0.1–0.9%, Mn: 0.1–2%, Cr: 15–22%, Ni: 8–15%, Ti: 0.002–0.05%, Nb: 0.3–1.5%, sol.Al: 0.0005–0.03%, N: 0.005–0.2% and O (oxygen): 0.001–0.008%, and at least one alloying element selected from at least one group mentioned below, and the balance Fe and impurities, and also characterized by an entire structure having a fine grained structure wherein austenitic grain size is No. 7 or more, the first group: Ca, Mg, Zr, B, Pd, Hf and REM of 0.0001–0.2 mass % respectively, and the second group: Cu, Mo and W of 0.01–5 mass % respectively.

3. An austenitic stainless steel tube excellent in steam oxidation resistance, characterized by consisting of, by mass %, C: 0.03–0.12%, Si: 0.1–0.9%, Mn: 0.1–2%, Cr: 15–22%, Ni: 8–15%, Ti: 0.002–0.05%, Nb: 0.3–1.5%, sol.Al: 0.0005–0.03%, N: 0.005–0.2% and O (oxygen): 0.001–0.008%, and the balance Fe and impurities, and also characterized by an entire structure having a fine grained structure wherein austenitic grain size is No. 7 or more and a mixed grain ratio is 10% or less.

4. An austenitic stainless steel tube excellent in steam oxidation resistance, characterized by consisting of, by mass %, C: 0.03–0.12%, Si: 0.1–0.9%, Mn: 0.1–2%, Cr: 15–22%, Ni: 8–15%, Ti: 0.002–0.05%, Nb: 0.3–1.5%, sol.Al: 0.0005–0.03%, N: 0.005–0.2% and O (oxygen): 0.001–0.008%, and at least one alloying element selected from at least one group mentioned below, and the balance Fe and impurities, and also characterized by an entire structure having a fine grained structure wherein austenitic grain size is No. 7 or more and a mixed grain ratio is 10% or less, the first group: Ca, Mg, Zr, B, Pd, Hf and REM of 0.0001–0.2 mass % respectively, and the second group: Cu, Mo and W of 0.01–5 mass % respectively.

5. An austenitic stainless steel tube excellent in steam oxidation resistance according to any one of claim 1, characterized by the O (oxygen) content of not less than 0.001 mass % but less than 0.005 mass %.

6. An austenitic stainless steel tube excellent in steam oxidation resistance according to claim 2, characterized by the O (oxygen) content of not less than 0.001 mass % but less than 0.005 mass %.

7. An austenitic stainless steel tube excellent in steam oxidation resistance according to claim 3, characterized by the O (oxygen) content of not less than 0.001 mass % but less than 0.005 mass %.

8. An austenitic stainless steel tube excellent in steam oxidation resistance according to claim 4, characterized by the O (oxygen) content of not less than 0.00 1 mass % but less than 0.005 mass %.

* * * * *